US006149528A

United States Patent [19]

Volz et al.

[11] Patent Number: 6,149,528

[45] Date of Patent: Nov. 21, 2000

[54] AMUSEMENT RIDE VEHICLE FOLDING SEAT

[75] Inventors: David G. Volz, Orlando, Fla.; Chad E. Brose, Eden Prairie, Minn.; Joseph o Chadwick, Eden Prairie, Minn.; David L. Manlove, Eden Prairie, Minn.

[73] Assignee: Universal City Studio, Inc., Universal City, Calif.

[21] Appl. No.: 09/270,136

[22] Filed: Mar. 16, 1999

[51] Int. Cl.[7] ..... A63G 1/08

[52] U.S. Cl. ..... 472/43; 472/29

[58] Field of Search ..... 472/43, 44, 29; 297/14, 15; 296/65.05, 65.09; 414/921, 540, 543; 104/53

[56] References Cited

U.S. PATENT DOCUMENTS

| | | | |
|---|---|---|---|
| 1,471,001 | 10/1923 | Nicholson | 296/65.05 |
| 3,328,069 | 6/1967 | Dumas | 296/65.05 |
| 3,594,037 | 7/1971 | Sherman | 297/14 |
| 4,103,934 | 8/1978 | Arnholt et al. | 280/744 |
| 4,799,632 | 1/1989 | Baymak et al. | 297/14 X |
| 4,902,069 | 2/1990 | Lehnert | 297/14 |
| 5,259,081 | 11/1993 | Henderson | 14/71.1 |
| 5,388,937 | 2/1995 | Farsai | 410/9 |
| 5,489,141 | 2/1996 | Strausbaugh et al. | 297/14 X |
| 5,492,389 | 2/1996 | McClintock et al. | 297/14 |
| 5,564,984 | 10/1996 | Mirabella et al. | 472/43 |
| 5,829,201 | 11/1998 | Schelter et al. | 52/9 |
| 5,884,563 | 3/1999 | Sheldon et al. | 104/53 |

*Primary Examiner*—Kien T. Nguyen
*Attorney, Agent, or Firm*—Lyon & Lyon LLP

[57] ABSTRACT

An amusement ride vehicle includes a seat for accommodating a rider in a wheelchair. A door attached to the seat pivots outwardly. The seat bottom folds down and a seat back pivotably attached to the seat bottom retracts, to create space for maneuvering a wheelchair and reveals storage panels for wheelchair tiedowns. A fixed companion seat is provided alongside the space created for the wheelchair. To accommodate non-physically disabled riders, the seat bottom is moved to an up position and the seat back moved out, to align with the seat bottom and back of the fixed companion seat. The door, when in the closed position, engages a seat lock that supports the folding seat on both sides.

13 Claims, 10 Drawing Sheets

AMUSEMENT RIDE VEHICLE FOLDING SEAT

BACKGROUND OF THE INVENTION

The field of the invention is theme or amusement park ride attractions.

Theme or amusement parks have become increasingly popular. More sophisticated arid creative ride attractions have been principle factors in the popularity and success of such parks. Many park ride attractions typically involve vehicles, such as roller coaster type cars, rail cars, automobile type cars, rafts or boats etc. moving along a closed or continuous loop path. In general, the vehicles in these types of ride attractions have seats for several passengers. The passengers step from a loading platform into the vehicles and seat themselves. At the end of the ride, the passengers similarly step or climb out of the vehicle.

Because access to the ride vehicles has generally required that the passengers be able to walk or climb into the seats of the vehicle, the physically handicapped have been largely prevented from enjoying these types of theme park ride attractions. Wheelchair users and others having limited mobility, while increasingly gaining access to public and private buildings, transportation systems and other facilities, often remain excluded from many amusement rides. Accordingly, improvements in theme park ride attractions are necessary to better accommodate the physically disabled.

SUMMARY OF THE INVENTION

In a first aspect of the invention, an amusement ride vehicle is movable along a vehicle path. The vehicle advantageously has a seat bottom pivotable between an up position, for supporting a seated passenger, and a down position, wherein the seat bottom is moved out of the way to provide space in the vehicle for a wheelchair.

In a second separate aspect of the invention, a door is pivotably attached to the vehicle near the seat bottom. The door is movable from an open position, to provide wheelchair access into the vehicle, and a closed position.

In a third separate aspect of the invention, the door in the closed position supports the seat bottom in the up position.

In a fourth separate aspect of the invention, a seat back is pivotably attached to the seat bottom, and to the vehicle, to form a linkage which retracts the seat back as the seat bottom is moved from the up position to the down position, providing more room for a wheelchair.

In a fifth separate aspect of the invention, a fixed companion seat is provided adjacent to the movable seat back and seat bottom.

In a sixth separate aspect of the invention a tie down system is provided to secure a wheelchair in place.

In a seventh separate aspect of the invention, a door lock locks the vehicle door during the ride.

In an eighth aspect of the invention, two or more of the above described aspects are used in combination.

Accordingly, it is an object of the invention to provide an amusement ride vehicle for accommodating physically disabled persons. Other and further objects and advantages will appear hereinafter.

BRIEF DESCRIPTION OF THE DRAWINGS

In the drawings, wherein the same reference numbers denote the same elements, throughout the several views.

DETAILED DESCRIPTION OF THE DRAWINGS

Figure 1:
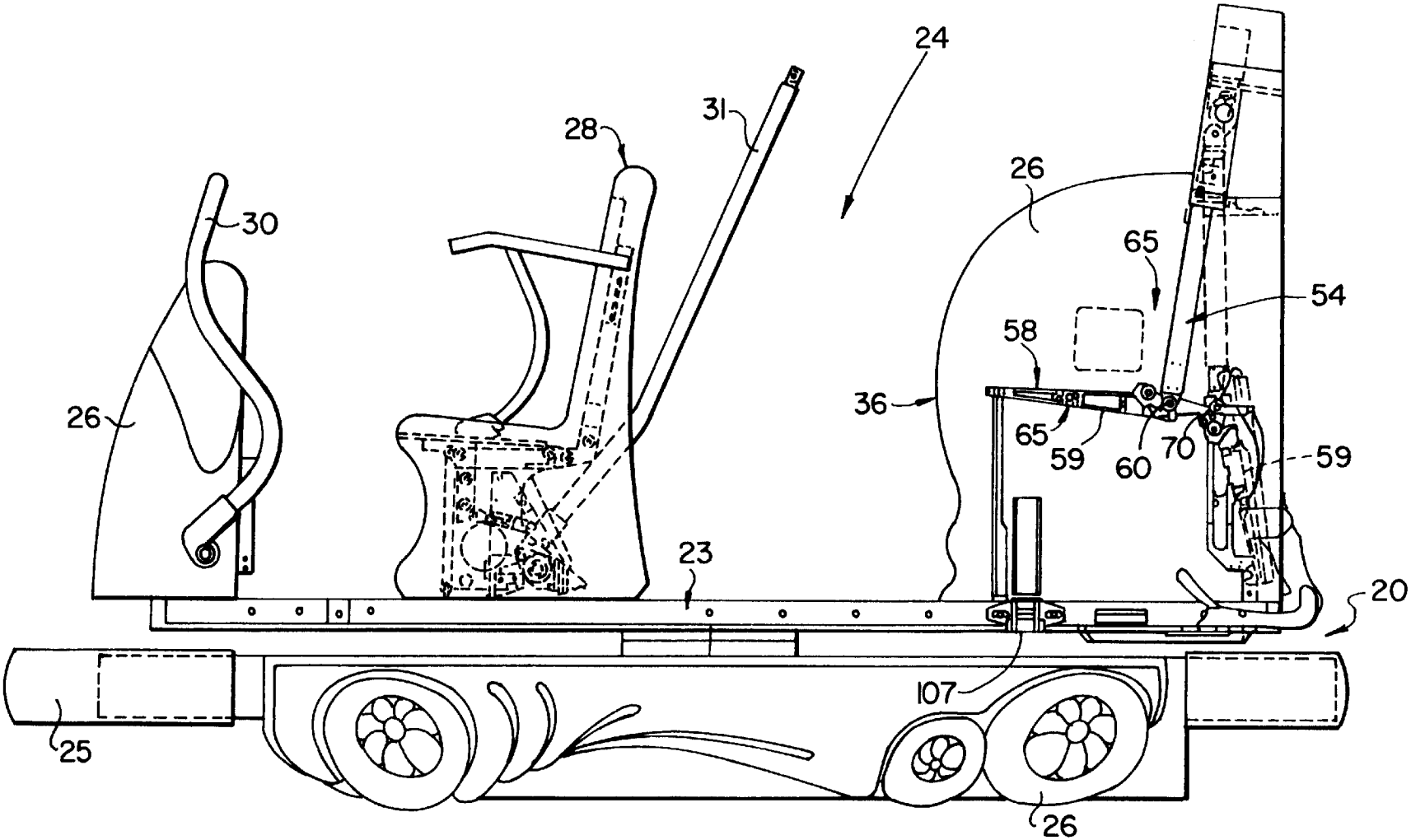
FIG. 1 is a side elevation view of the ride vehicle of the present invention, showing a folding seat in solid lines in the up position.
Figure 2:
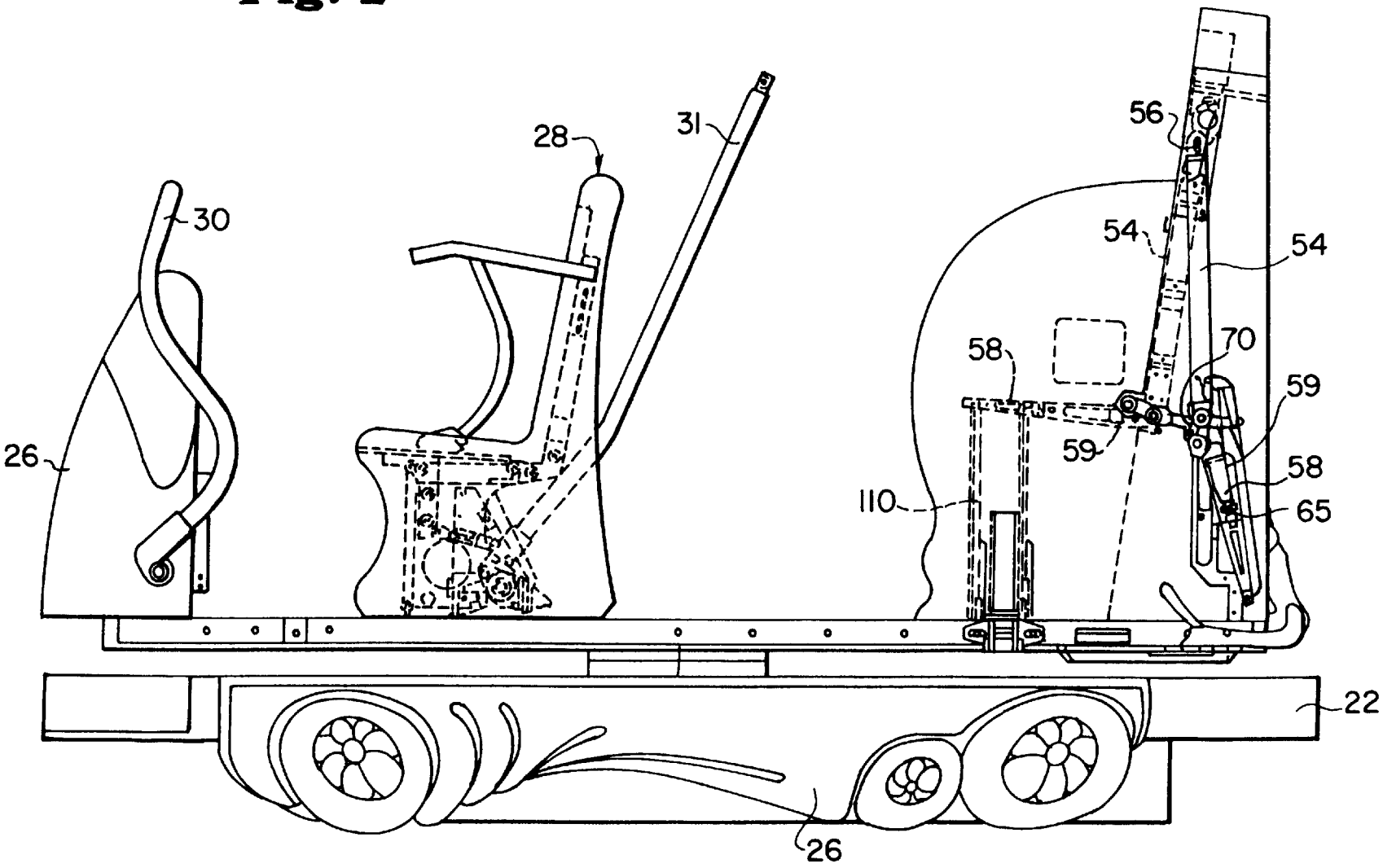
FIG. 2 is a side elevation view thereof showing the folding seat in solid lines in the down or folded position.

Turning now in detail to the drawings, as shown in FIGS. 1–6, the present amusement ride vehicle 20 includes a chassis 22, adapted to ride on a track. A platform 23 is attached to the chassis 22. Bumpers 25 are attached to the front and back ends of the chassis 22. The platform 23 can rotate during the ride or remained fixed. Thematic body panels 26 on the sides and ends of the vehicle add to the theme of the ride. The vehicle 20 has a front seat 28 and a rear seat 32 attached to the platform 23. The platform 23, seats 28, 32 and body panels 26 make up a vehicle body 24 supported on the chassis 22. Movable front and rear seat safety or lap bars 30 and 31 are associated with the front and rear seats 28 and 32.

Figure 8:
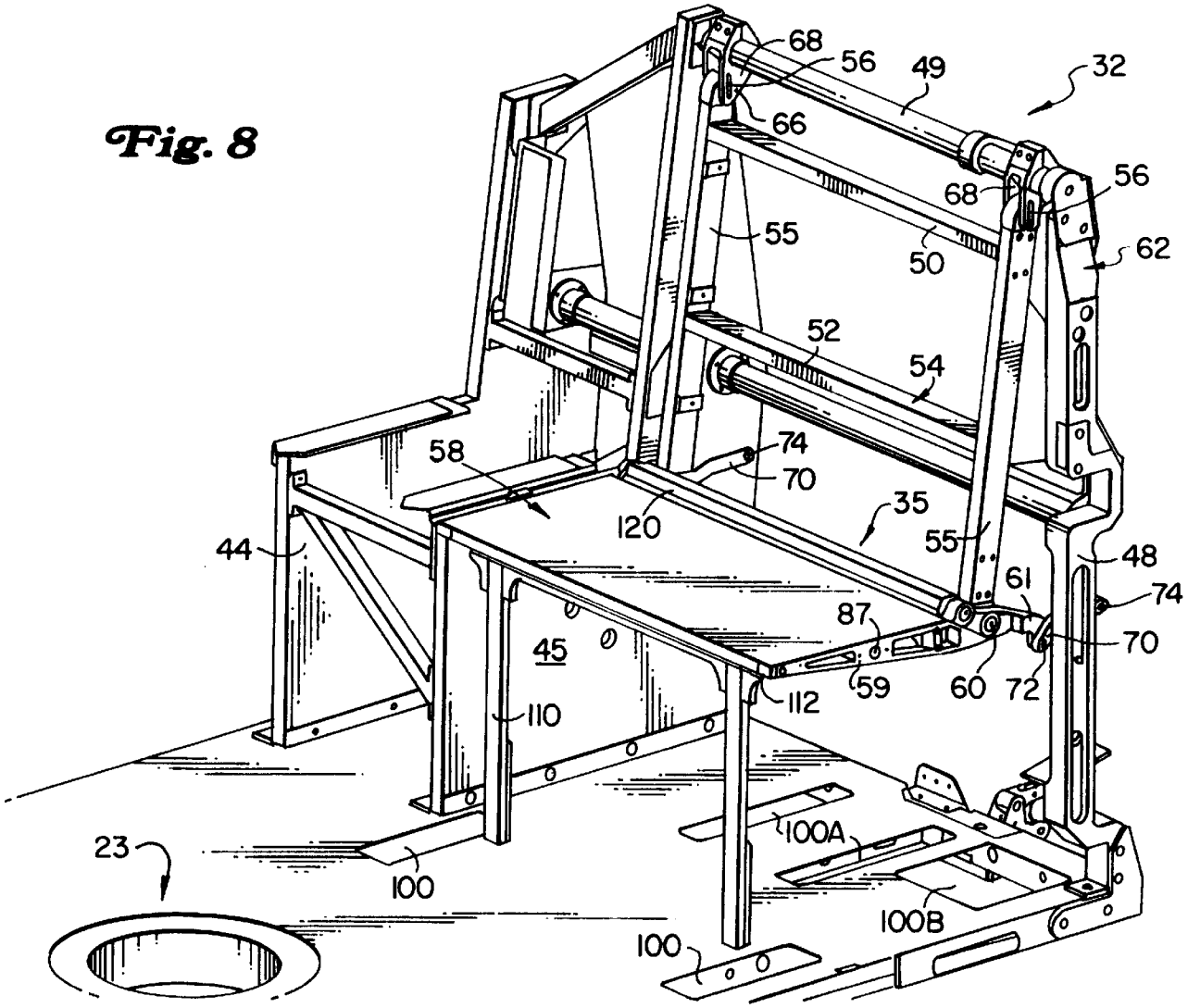
FIG. 8 is a perspective view of the seat as shown in FIG. 4, with various covering surfaces and the door removed, to illustrate internal construction of the rear seat and door, and showing the seat in the up position.
Figure 9:
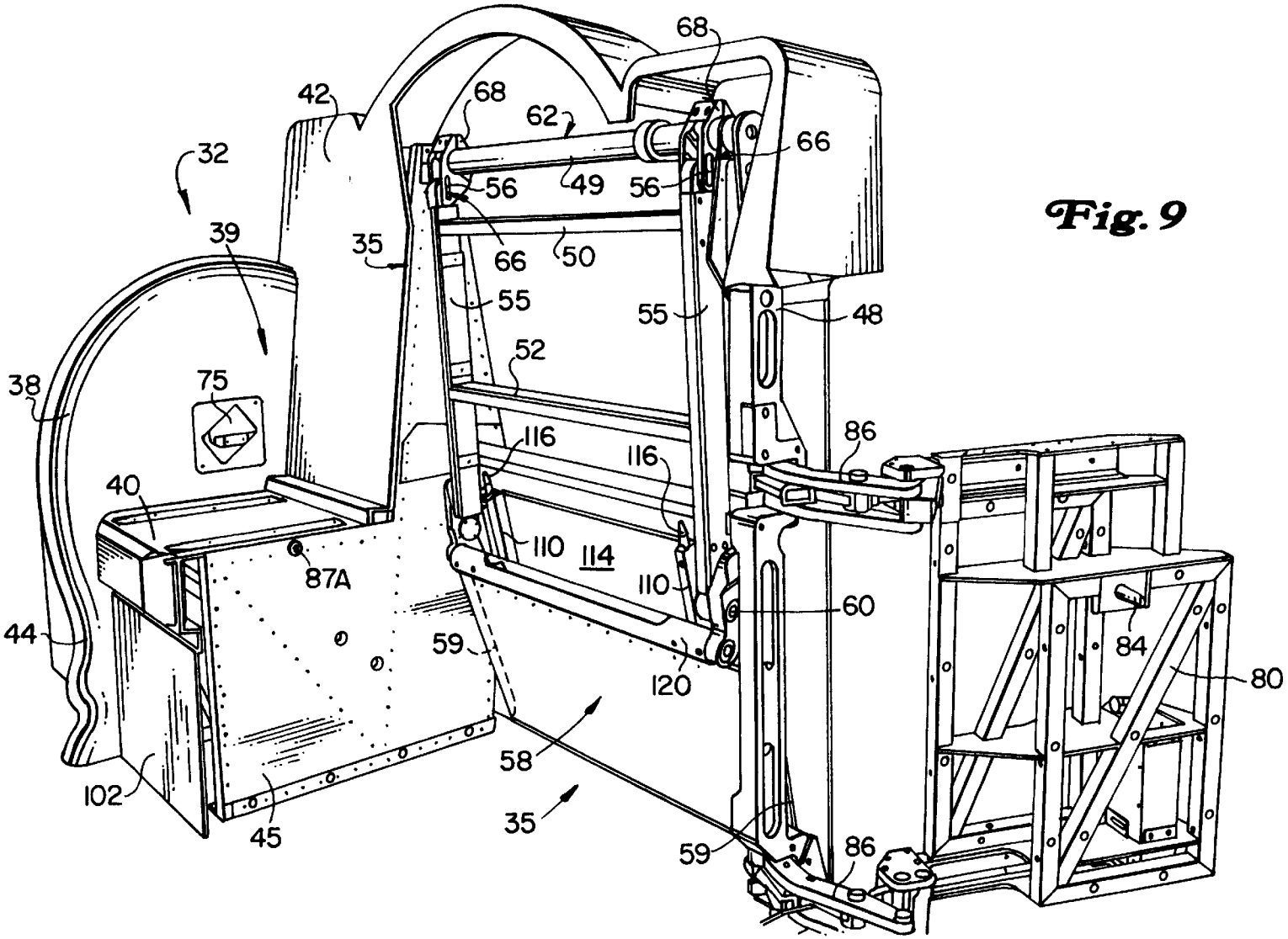
FIG. 9 is a perspective view thereof showing the seat in the down position, and the door open.

Referring to FIGS. 8 and 9, the seat covering surfaces are removed from the drawings to show underlying structure. A rear seat structural frame 35 is attached to the vehicle platform 23 or body 24. The rear seat frame 35 includes a right side frame 44 and a midpoint frame 45. A door side vertical beam 48 extends upwardly at the left side of the platform 23. A top cross beam 49 is attached at the top ends of the midpoint frame 45 and door side vertical beam 48, to form a rectangular upright frame 62.

A seat back 54 is pivotably attached to the upright frame 62 at upper pivot/slot joints 56. The seat back 54 includes upper and lower horizontal cross beams 50 and 52, joined by right and left side legs 55. The upper ends of the side legs 55 are attached to the upright frame 62 at the upper pivot/slot joints 56. The upper pivot/slot joints 56 are formed via pins or bolts extending through slots 66 in both arms of the clevis 68 attached to the top cross beam 49.

A seat bottom 58 is constructed similar to the seat back frame 54. Referring to FIG. 8, seat side arms 59 are pivotably attached to the side legs 55 of the seat back frame 54 at pivot joints 60. The back ends 61 of the seat side arms 59 are pivotably attached to the front end of a link 70, at link pivot joints 72, at each side of the seat bottom. The back end of the links 70 are pivotably attached to the midpoint frame 45 and door side vertical beam 48, at vertical beam pivot joints 74.

As shown in FIG. 9, at the left side of the rear seat 32, a door 36 is pivotably attached to the door side vertical beam 48 via upper and lower multiple point hinges 86. The door 36 includes an internal structural doorframe 80 having a seat support pin 84.

Figure 10:
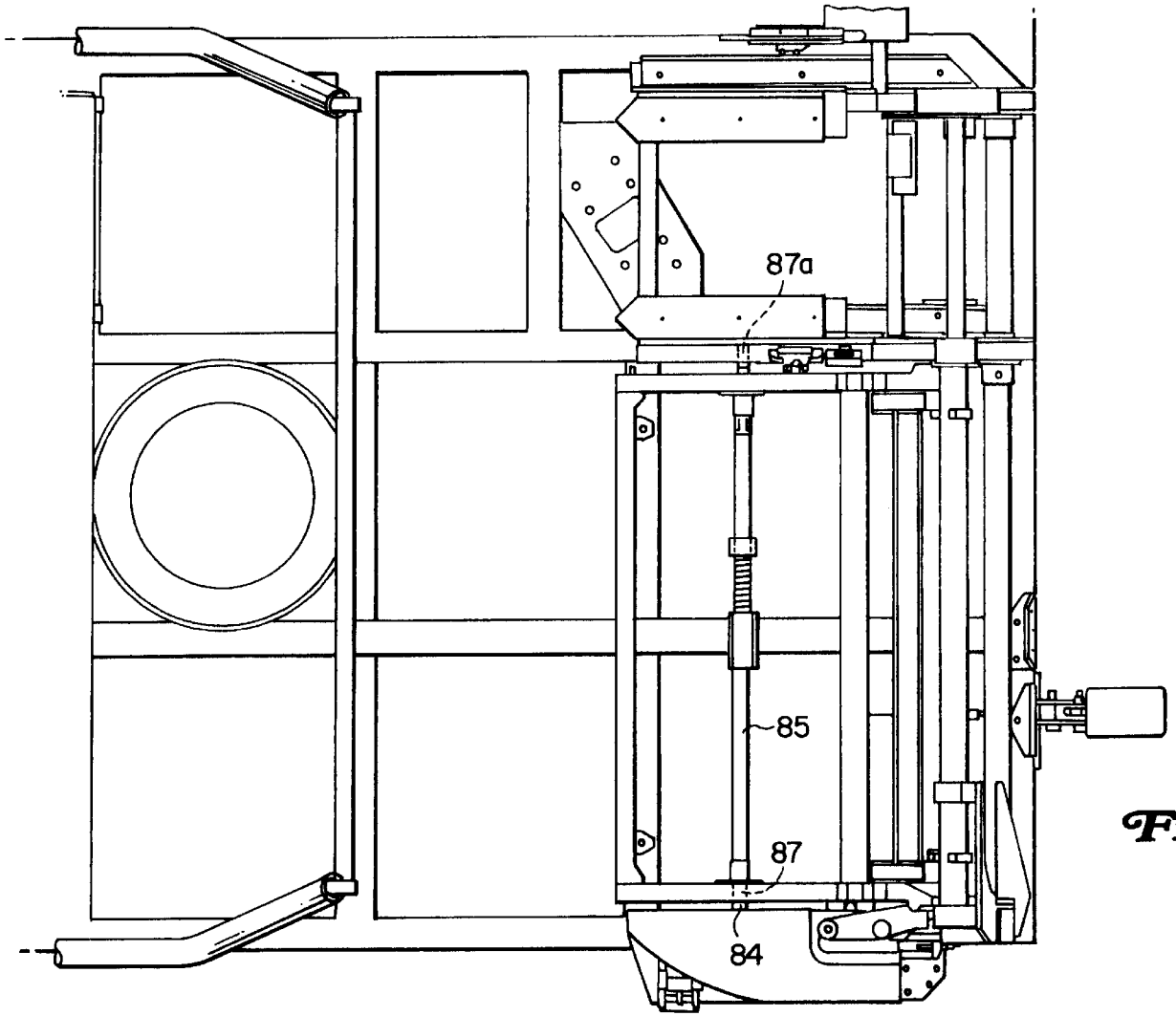
FIG. 10 is a plan view of the back end of the vehicle shown in FIG. 1, with various components removed for purposes of illustration.

As shown in FIG. 10, a two-piece spring loaded seat lock pin shaft 85 extends through the seat bottom 58, in alignment with the pin opening 87. As the seat pin 84 on the door frame 80 moves into the pin opening 87 (as the door is closed), the seat lock pin shaft is pushed towards the fixed sidewall 38 (up in FIG. 10) and the end of the shaft 85 moves into the mid-point frame pin opening 87*a*. Consequently, the seat bottom 58 is locked in place on both sides. When the door is opened and the seat pin 84 is withdrawn from the pin opening 87, the spring on the shaft 85 pulls the shaft 85 out of the opening 87*a*, to unlock the seat bottom 58.

Figure 4:
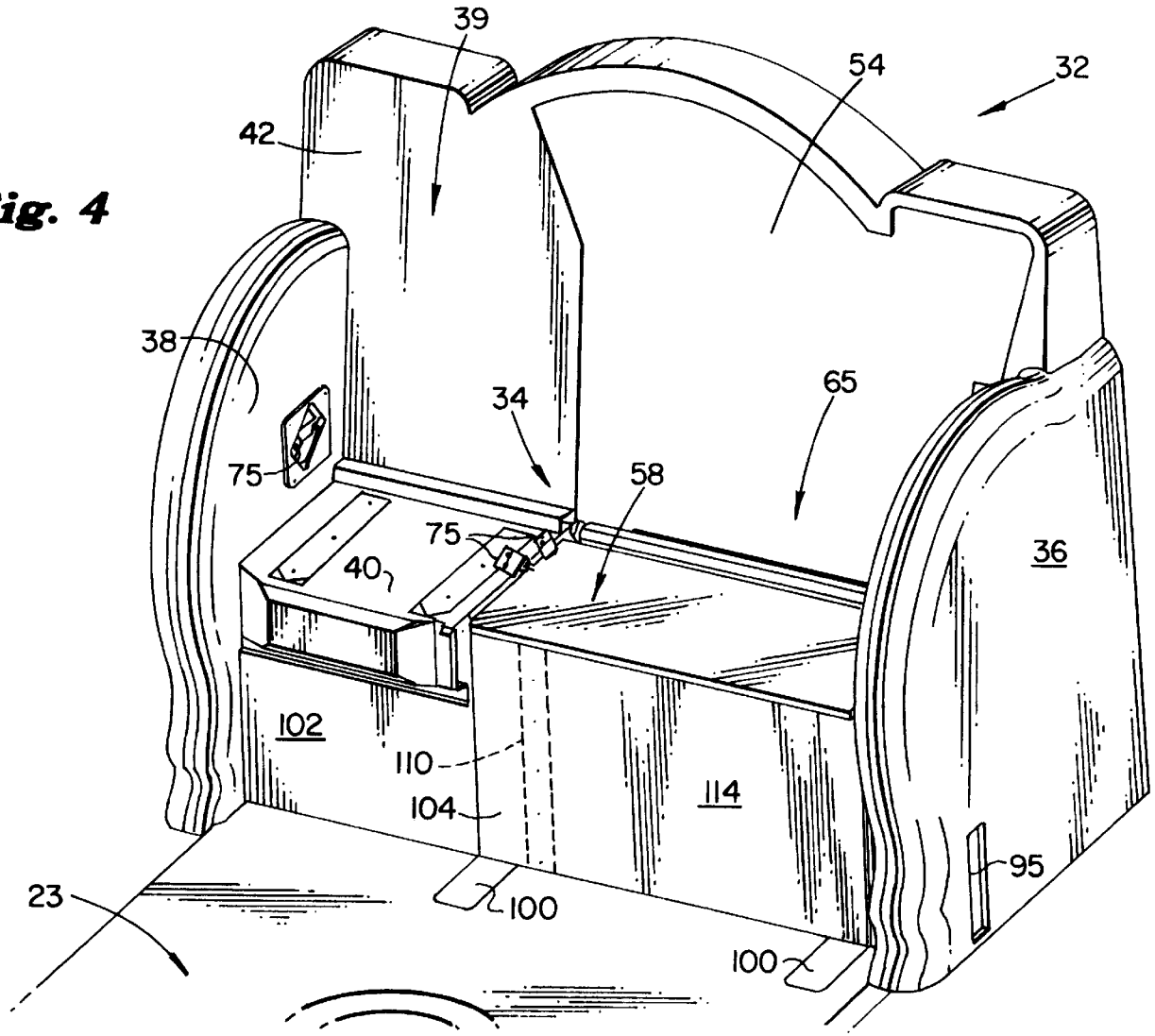
FIG. 4 is a perspective view showing the rear seat of the vehicle configured for nonphysically disabled riders.

The right side of the rear seat 32 preferably has a fixed sidewall 38 with a fixed seat back 42 and fixed seat bottom 40, forming a fixed companion seat 39, for use by a non-physically disabled rider. Referring to FIG. 4, the fixed companion seat 39 includes a fixed kick panel 102 below the companion seat bottom 40. Seat padding and seat belts are omitted from FIG. 4 for clarity of illustration. The positions of the companion seat 39 and the door 36 can of course be reversed depending on the travel direction of the vehicle and/or the loading/unloading configuration.

In use, if there are no physically disabled riders to be accommodated, the rear seat 32 on the platform 23 of vehicle 20 is positioned as shown in FIGS. 1 and 4. The folding rear seat 65, formed by the seat back 54 and seat bottom 58, is in the up position. The seat back 54 is flush, or near flush with the fixed companion seat back 42. Similarly, the seat bottom 58 is flush, or near flush with the fixed companion seat bottom 40, so that the rear seat 32 forms a generally uniform bench 34 accommodating, for example, 2–4 riders.

The folding seat 65 includes a folding or removable kick panel 104 assembly. With the folding seat 65 in the up position, as shown in FIG. 4, the kick panel 104 conceals a wheelchair tie down system 101. Forward access panels 100 covering the tie down system 101 are locked down in place by the upright kick panel 104. The folding kick panel assembly 104 has a pair of folding legs 110. Each leg 110 is attached to leg bar 112 pivotably contained or attached near the front end of the seat bottom 58. A cover panel 114 is attached to the legs 110. Each leg has a floor pin 116 which is held within a floor opening 118, when the seat 65 is up or unfolded. The entire kick panel assembly 104 is pivotable about the seat bottom, so that it can be pivoted or folded out of the way, as shown in FIG. 9, when the seat 65 is folded.

To accommodate a physically disabled rider in a wheelchair, a ride operator opens the door 36 by pulling on a release handle 95, and moving the door 36 from the closed position, shown in FIG. 4, to the open position, shown in FIG. 9. The multiple point hinges 86 allow the door 36 to be pivoted at least 90° and preferably to 135°, so that the door 36 does not interfere with wheelchair access into the vehicle 20.

The ride operator then pulls up the seat bottom 58. The seat 65 moves up slightly in the slots at the joints 56, as shown in FIG. 9. The floor pins 116 of the kick panel assembly 104 area withdrawn from the floor openings 118. The operator stows or folds the kick panel 104 (shown in FIG. 4) under the seat bottom 58. The seat bottom is then rotated downwardly (counterclockwise about joint 60 in FIG. 8). As this occurs, the links 70 pivot clockwise about the vertical beam pivot joints 74. The links 70 move through an over-center position relative to the back ends of the seat side arms 59. The seat moves from the open or up position shown in solid lines in FIG. 1, to the down or folded position shown in phantom lines in FIG. 1. As the seat bottom pivots downwardly counter clockwise relative to the side legs 55 about pivot points 60, the seat back 54 pivots counter clockwise about the upper pivot points 56, into the retracted or folded position shown in FIG. 9.

With the door 36 fully opened, and the seat bottom 58 in the down or folded position, and the seat back 54 in the retracted position, a large access space 98 is created in the rear seat 32, to accommodate a wheelchair. A wheelchair wheel rest 120 extends across between the side legs 55, to help secure a wheelchair in place.

Figure 3:
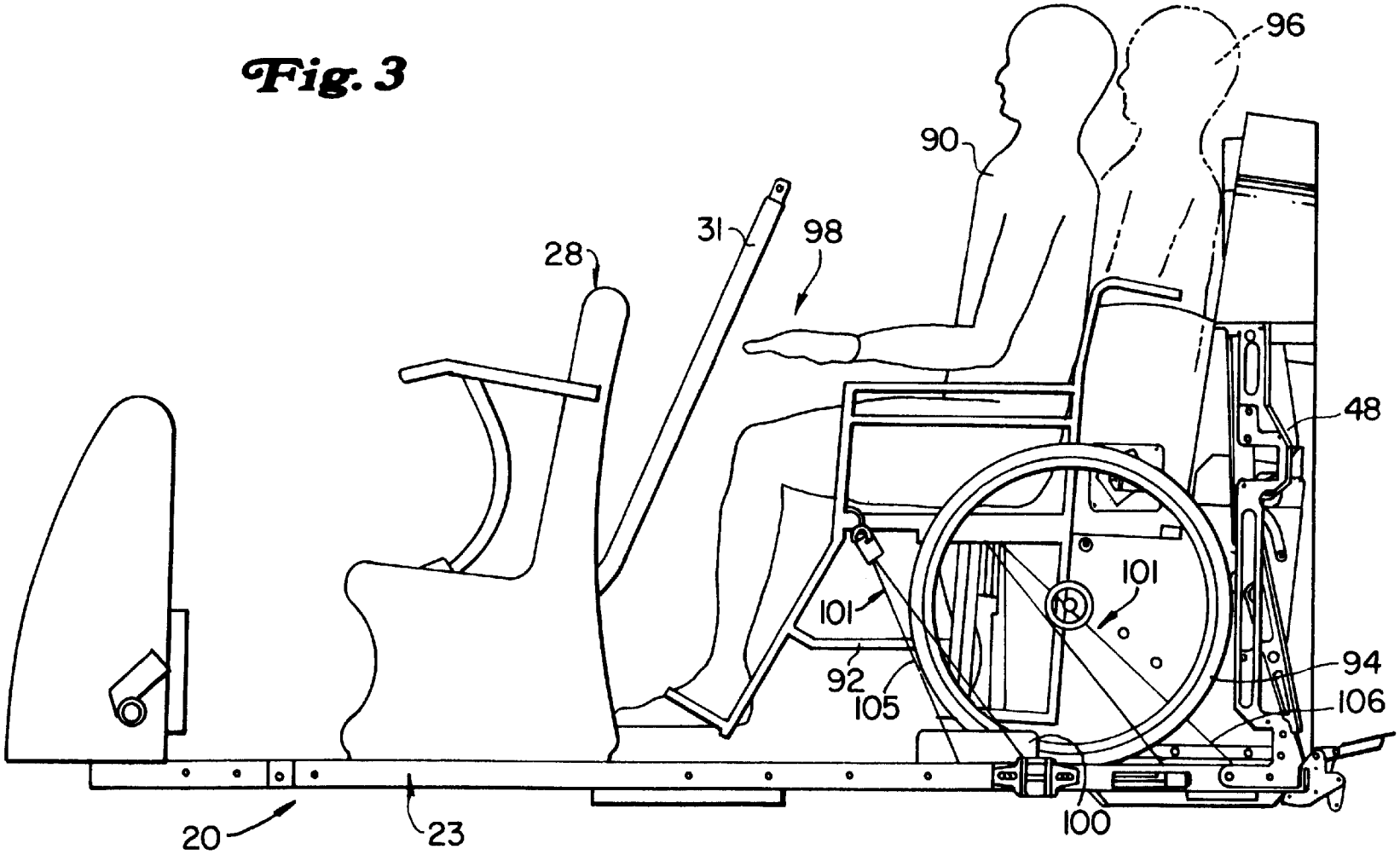
FIG. 3 is a side elevation view thereof showing riders in the vehicle.
Figure 7:
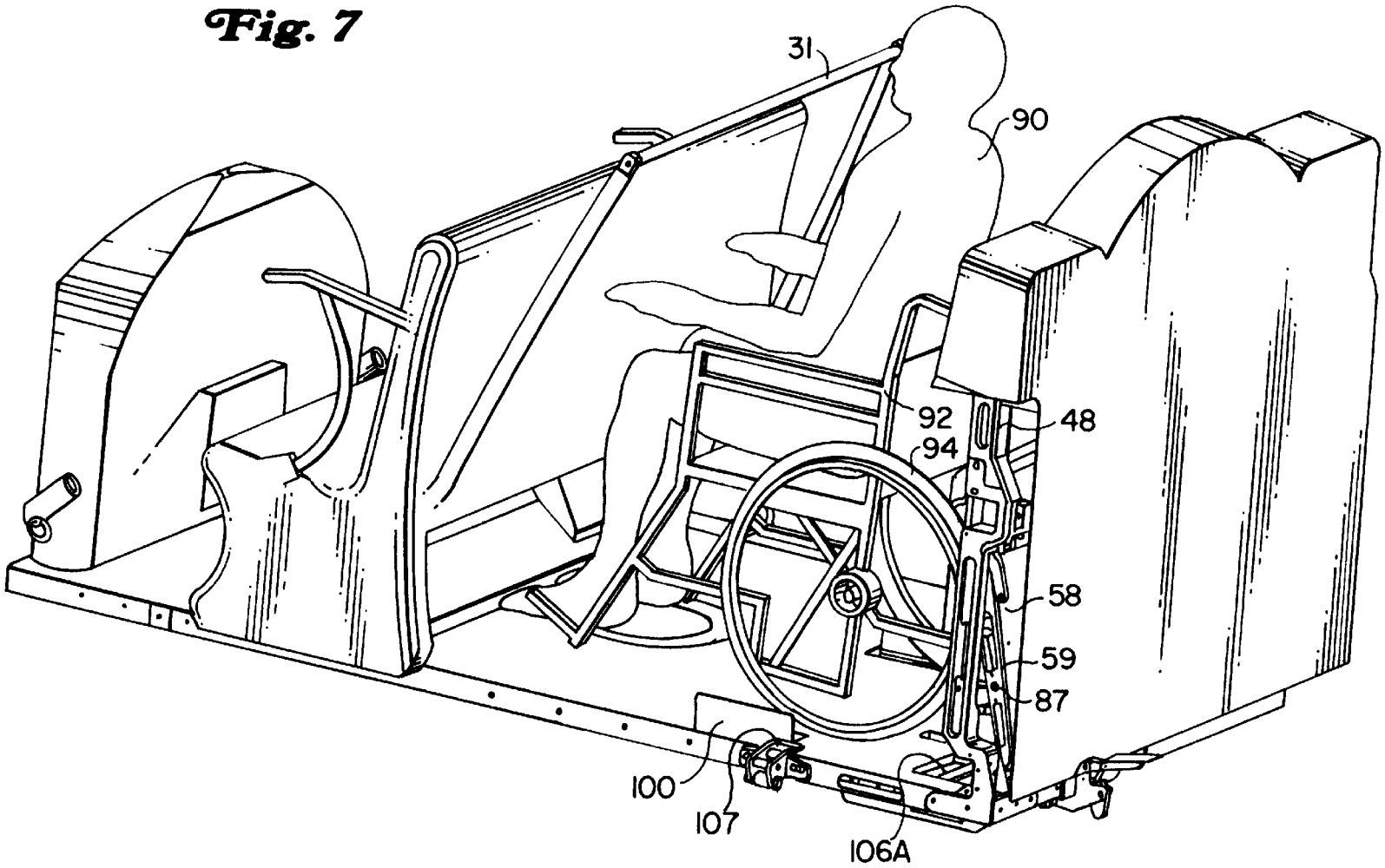
FIG. 7 is a perspective view of a physically disabled rider in a wheelchair in the vehicle.

Referring to FIGS. 3 and 7, the wheelchair 92 is moved on the platform 23 and into the space 98. The back wheels 94 of the wheelchair 92 are positioned against the now exposed wheel rest 120. The wheelchair rest 120 has a hard rubber flat surface, which is rotated to face the wheelchair when the seat is folded. The wheelchair rest 120 provides a firm surface for the wheels of the wheelchair to be secured against, and prevents the wheelchair wheels from pushing into the seat pad on the seat bottom 58. The wheelchair is secured into place with a tie down system 101. The tie down system has front and rear wheelchair restraining tie downs 105 and 106 contained within recesses in the platform 23 and covered by access panels 100 and 100A. The panels 100 are opened when the tie down system is in use. The wheelchair tie downs 105 and 106 are pulled out and attached to the wheelchair then pulled taut and locked. The tie downs 105 and 106 pull the wheelchair back and secure it in place with the wheelchair wheels held tight against the wheelchair rest 120.

The seat belts may be adjustable in length or have an inertia type belt tensioners/retractors. Seat belts 75 are secured around the physically disabled person 90 in the wheelchair 92. The companion rider uses the regular seat belts 75. The lap bar 31, if provided, is pulled down to further secure the riders and to provide a rigid handhold. The lap bar is pulled down as far as it can go, typically coming to rest on the armrests of the wheelchair. The tie down access panels conveniently locate the tie downs while concealing them when they are not in use, and maintaining a flat unobstructed floor surface.

At the end of the ride, the physically disabled person 94 in the wheelchair exits the vehicle 20 following the reverse sequence of steps described above. A ride operator unlocks and opens the door 36 via the release handle 95. The tie down system 101 is released and the wheelchair 92 is maneuvered off of the vehicle 20 and onto the loading/unload platform of the ride attraction.

To convert the rear seat 32 for nonphysically disabled riders 96, the ride operator stores the tie down system 101. Specifically, the tie downs 105 and 106, are replaced into the recesses and the access panels 100 and 100A are closed over them. The ride operator then lifts the seat bottom 58 forward from the down position, to the up or unfolded position. The seat back 54 pivots outwardly. The links pivot counter clockwise (as viewed in FIG. 8) past an over center position relative to the back-ends of the seat side arms 59, keeping the seat locked up or open. The seat is lifted higher then its normal position so the kick panel 104 can be folded from under the seat. The floor pins 116 on the kick panel 110 are placed into the floor openings 118. This restores the rear seat 32 to the position shown in FIG. 4.

Figure 5:
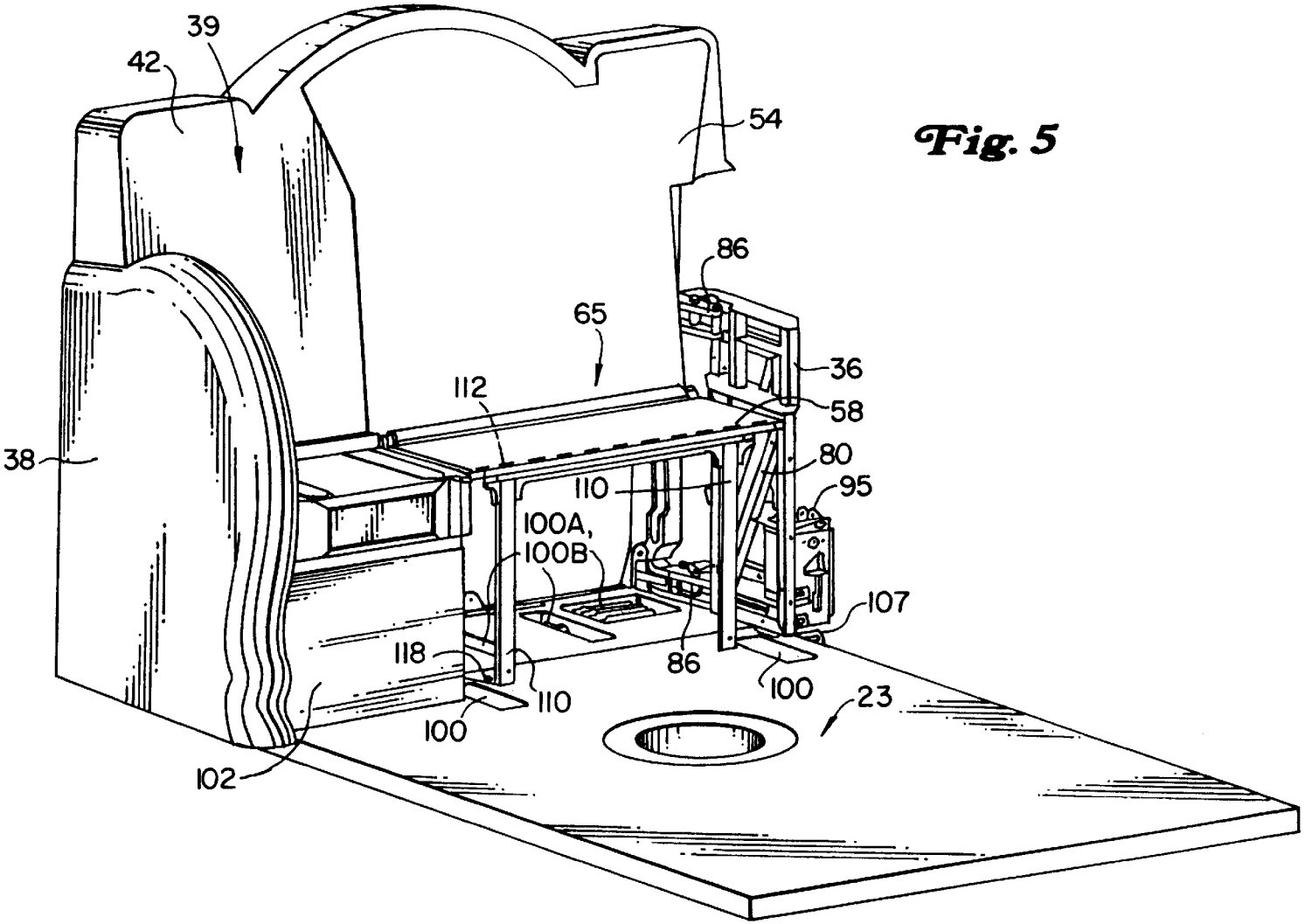
FIG. 5 is a perspective view thereof, with some covering surfaces removed, to illustrate internal components.
Figure 6:
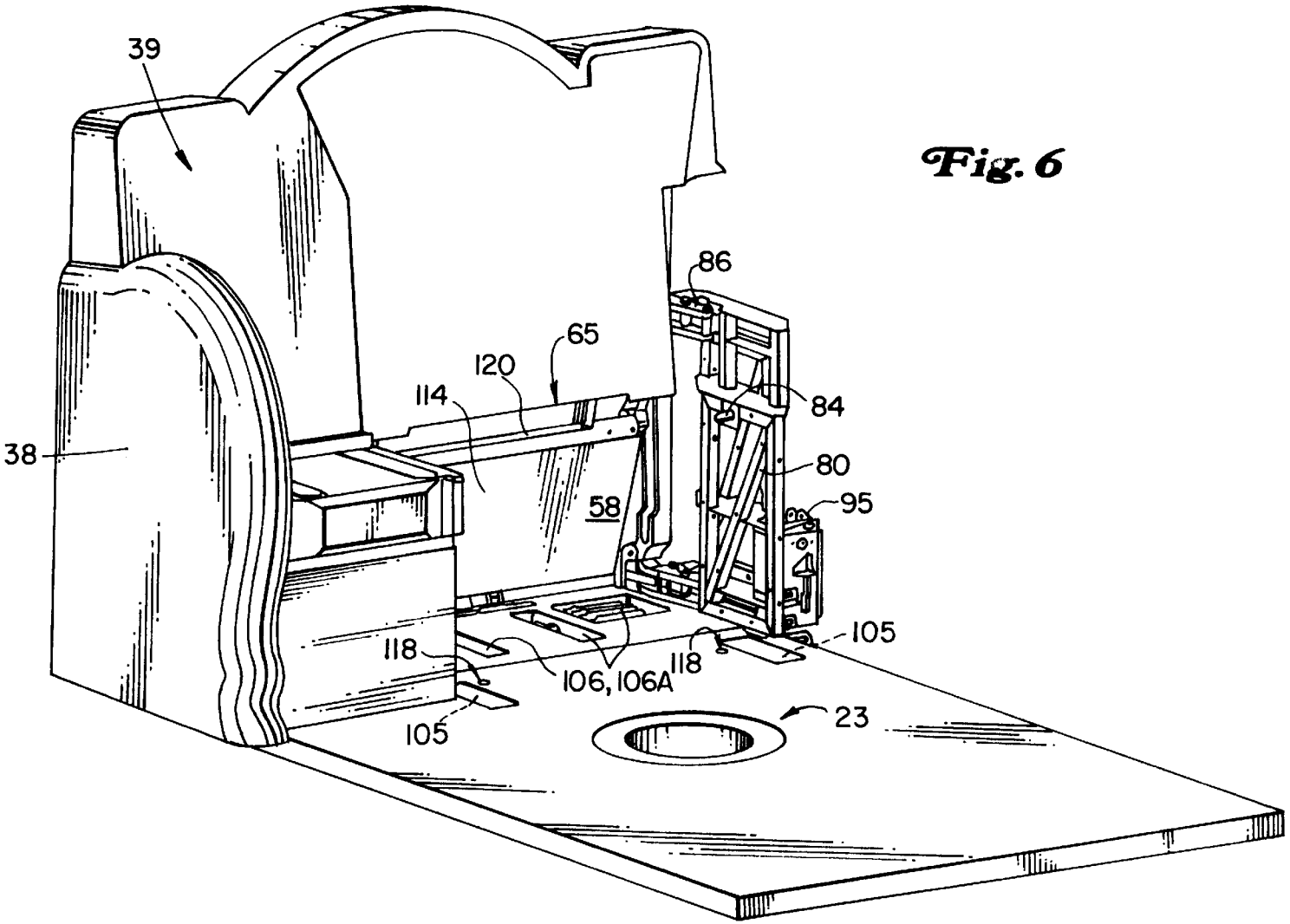
FIG. 6 is a perspective view of the rear seat of the vehicle, with some covering surfaces removed, configured for a physically disabled rider in a wheelchair.

The door 36 is closed engaging the seat pin 84 into the pin opening 87 in the seat side arm 59. Pin opening 87 holds one end of the seat lock pin/shaft 85 which engages another pin opening 87A in the mid point frame. The seat pin 84 attached to the door frame 80 engages the seat side arm 59 of the seat bottom 58. The seat lock pin/shaft 85 engages into the pin opening 87A in the midpoint frame 45. The seat bottom 58 is therefore secured in place when the seat bottom 58 is in the up position. The doorlock on the door engages a door stand 107 on the platform 23, as shown in FIG. 5. The door stand 107 is a mechanical stop and lock for the door 36 and also vertically supports the cantilevered front end of the door 36.

The folding seat 65 can be quickly folded down and out of the way, to provide the access space 98 for maneuvering a wheelchair 92 onto the vehicle 20.

Thus, a novel ride vehicle seat has been shown and described. Various modifications and substitutions may be made without departing from the spirit and scope of the invention. The invention, therefore, should not be restricted, except by the following claims and their equivalents.

We claim:

1. An amusement ride attraction comprising:

a vehicle including:

a floor;

a movable seat bottom pivotably attached to the vehicle and alternately movable, from an up position, wherein the seat bottom is substantially horizontal, for supporting a seated rider, towards the floor and into a down position, wherein the seat bottom is approximately vertical, to provide space in the vehicle for a wheelchair; and a wheelchair restraint on the vehicle.

2. The amusement ride of claim 1 further comprising a fixed seat bottom attached to the vehicle alongside the movable seat bottom.

3. The amusement ride of claim 2 wherein the fixed seat bottom is generally coplanar with the movable seat bottom, when the movable seat bottom is in the up position.

4. An amusement ride attraction comprising:

a vehicle path;

a vehicle movable along the vehicle path, the vehicle including:

a movable seat bottom pivotably attached to the vehicle and movable between an up position, wherein the seat bottom is substantially horizontal, for supporting a seated rider, and a down position, wherein the seat bottom is approximately vertical, to provide space in the vehicle for a wheelchair;

a door pivotably attached to the vehicle adjacent to the seat bottom, with the door movable between opened and closed positions; and a seat bottom support on the door engageable to the movable seat bottom, when the movable seat bottom is in the down position and when the door is in the closed position.

5. An amusement ride attraction comprising:

a vehicle path;

a vehicle movable along the vehicle path, the vehicle including:

a movable seat bottom pivotably attached to the vehicle and movable between an up position, wherein the seat bottom is substantially horizontal, for supporting a seated rider, and a down position, wherein the seat bottom is approximately vertical, to provide space in the vehicle for a wheelchair;

a door pivotably attached to the vehicle adjacent to the seat bottom, with the door movable between opened and closed positions; and an upright attached to the vehicle, a seat back pivotably attached to the upright and to the movable seat bottom, and a link pivotably attached to the upright and to the seat bottom.

6. An amusement ride attraction comprising:

a vehicle path;

a vehicle movable along the vehicle path, the vehicle including:

a movable seat bottom pivotably attached to the vehicle and movable between an up position, wherein the seat bottom is substantially horizontal, for supporting a seated rider, and a down position, wherein the seat bottom is approximately vertical, to provide space in the vehicle for a wheelchair:

a door pivotably attached to the vehicle adjacent to the seat bottom, with the door movable between opened and closed positions;

a fixed seat bottom attached to the vehicle alongside the movable seat bottom; and a forward seat unit on the vehicle, spaced apart from the fixed seat bottom by an access space, for allowing a rider to enter the vehicle and sit on the fixed seat bottom.

7. A ride vehicle for an amusement ride, comprising:

a vehicle body;

a seat bottom on the vehicle body;

a seat back above the seat bottom;

folding means for folding the seat bottom from an up position to a down position; and retracting means for moving the seat back from an extended position to a retracted position.

8. The ride vehicle of claim 7 wherein the folding means is connected to the retracting means, so that when the seat bottom is folded down, the seat back simultaneously moves into the retracted position.

9. A ride vehicle for an amusement ride, comprising:

a vehicle body;

a seat bottom on the vehicle body;

a seat back above the seat bottom;

folding means for folding the seat bottom from an up position to a down position;

retracting means for moving the seat back from an extended position to a retracted position;

the folding means being connected to the retracting means, so that when the seat bottom is folded down, the seat back simultaneously moves into the retracted position; and an upright on the vehicle, with the seat back having an upper end pivotably attached to the upright.

10. The ride vehicle of claim 9 wherein the retracting means comprises a link pivotably attached to the upright and to the seat back.

11. A vehicle seat comprising:

an upright;

a seat back pivotably attached to the upright;

a seat bottom having a front end and a back end, with the seat bottom attached to the seat back at the pivot joint located between the front end and the back end of the seat bottom; and a link pivotably attached to the upright and to the back end of the seat bottom.

12. A ride vehicle for an amusement ride, comprising:

a vehicle body;

an upright support having a bottom end attached to the vehicle body, an upper end, and a mid-point between the bottom end and the upper end, an upright support having a front end, a back end, and a mid-point between them;

a link pivotably connected to the upright support at the upright support mid-point, and pivotably connected to the seat bottom near the back end of the seat;

a seat back having an upper end and a lower end, with the upper end of the seat back pivotably attached to the upper end of the upright support, and with the lower end of the seat back pivotably attached to the seat bottom at the seat mid-point.

13. An amusement ride attraction comprising:

a vehicle including:

a floor;

a movable seat bottom pivotably attached to the vehicle and alternately movable, from an up position, wherein the seat bottom is substantially horizontal, for supporting a seated rider, towards the floor and into a down position, wherein the seat bottom is approximately vertical, to provide space in the vehicle for a wheelchair; and a wheelchair restraint on the vehicle under the movable seat bottom.

* * * * *